US005903957A

United States Patent [19]

Le Manchec

[11] Patent Number: 5,903,957

[45] Date of Patent: May 18, 1999

[54] WINDOW CURTAIN HANGING DEVICE

[75] Inventor: Vincent Le Manchec, Leves, France

[73] Assignee: Ateliers, France

[21] Appl. No.: 08/860,598

[22] PCT Filed: Jan. 8, 1996

[86] PCT No.: PCT/FR96/00024

§ 371 Date: Jul. 2, 1997

§ 102(e) Date: Jul. 2, 1997

[87] PCT Pub. No.: WO96/21381

PCT Pub. Date: Jul. 18, 1996

[30] Foreign Application Priority Data

Jan. 9, 1995 [FR] France ..... 95 00151
Oct. 24, 1995 [FR] France ..... 95 12489

[51] Int. Cl.[6] ..... E05D 15/00

[52] U.S. Cl. ..... 16/87.2; 248/60

[58] Field of Search ..... 16/87.2, 108, 109, 16/87 R, DIG. 40; 248/60, 62; 4/608–610; 160/330

[56] References Cited

U.S. PATENT DOCUMENTS

| | | | |
|---|---|---|---|
| 1,666,298 | 4/1928 | Norris | 16/87.2 |
| 2,840,155 | 6/1958 | Stern | 16/87.2 |
| 2,988,314 | 6/1961 | Urich | 16/87.2 |
| 3,161,929 | 12/1964 | Swett | 16/87.2 |
| 5,339,884 | 8/1994 | Angerman | 16/87.2 |

FOREIGN PATENT DOCUMENTS

| | | |
|---|---|---|
| 241589 | 2/1910 | Germany . |
| 338569 | 5/1959 | Switzerland . |
| 1021869 | 3/1966 | United Kingdom . |

*Primary Examiner*—Chuck Y. Mah
*Attorney, Agent, or Firm*—Londa and Traub LLP

[57] ABSTRACT

A window curtain hanging device constituted by a plastics material strip whose two ends are for fixing to the top of a curtain and whose central portion (3, 3*a*) matches the shape of a curtain rod, the strip serving as a support for a decorative tab.

10 Claims, 2 Drawing Sheets

WINDOW CURTAIN HANGING DEVICE

The invention relates to a window curtain hanging device for use with curtain rods that are round, oval, or square, that perform the function of curtain poles on which rings conventionally slide, and referred to below simply as "rods".

U.S. Pat. No. 2,988,314 describes a plastics material element including a fastener for fastening to a curtain. That element has a section that is I-shaped, requiring its ends to be clipped together to provide "straps" that are rigid and parallel to each other in use.

A practice that is becoming more widespread for securing curtains to a rod consists in replacing conventional rings by tabs made of cloth that is similar to or matches that of the curtains. Such tabs are constituted by strips of cloth of greater or lesser width, and folded over to form a loop with the open end being sewn to the curtain, or including means for engaging a hook which is either mounted on a curtain-pleating tape secured to the curtain, or else is sewn directly to the top of the curtain. Such fastening nevertheless suffers from at least two drawbacks, one associated with the tabs being fastened to one side of the top of the curtain, thereby causing the top of the curtain to tilt slightly forwards or backwards, in particular when the curtain is an interlined curtain of heavy cloth. However, the more important drawback lies in the fact that the tabs slide poorly on rods when the curtain is drawn.

The invention solves the problem by providing a window curtain hanging device constituted by a strip of plastics material whose two ends are fixed to the top of the curtain and whose central portion matches the shape of a curtain rod, the strip serving as a support for a decorative tab.

In a first variant, the strip is constituted by two flexible straps of plastics material extending from opposite ends of a curved element of rigid plastics material, provided with tab-retaining means for retaining a decorative tab. The curved element of rigid plastics material slides well on a curtain rod regardless of whether it is round, square, or oval, and it makes the curtains easier to draw than when using a tab on its own.

The stiffness of the curved element may be obtained by using a greater thickness of the same plastics material as is used for the flexible straps, or by having stiffening ribs—e.g. a central rib and two lateral ribs, or a plurality of regularly spaced-apart ribs—, or by using a stiffer plastics material for the curved element. For cost reasons, the preferred solution consists in using stiffening ribs.

Advantageously, the device of the invention includes a fastener for fastening directly to the curtain, and preferably such a fastener enables the curtain to be placed between the two flexible straps of the device of the invention. Various methods of fastening can be envisaged when the tab and the device of the invention are fastened to one side only of the curtain, and in particular, in this case, it is possible to use clips with two hooks co-operating with hook-engaging means formed on the tabs and on the device of the invention.

When the curtain is placed between the two flexible straps, it is possible to envisage providing the free end of each strap with a male pushbutton element that is inwardly directed and to sew female pushbutton elements at appropriate locations on the top of the curtain. A particularly preferred device consists in using two flat-headed pins, one of which is hollow and houses the other, the two pins being secured to each other by snap-fastening or by screw engagement. One of the pins is passed through a hole formed in the bottom portion of one of the straps while the other pin is passed through a hole formed in the free end of the other strap, and they are united after passing through an orifice formed in the top of the curtain, which orifice is advantageously implemented in the form of an eyelet.

In order to prevent the decorative tab from sliding over the device of the invention, the top portion of the curved element is provided with tab-retaining elements, advantageously constituted by rims projecting on either side of said curved element. It is also possible to envisage giving the top (outer) surface of said curved element a texture that is non-slip for cloth, or to fix thereon a tape having loops or hooks and to provide the decorative tab with a tape having the other configuration. It is not necessary for the curved portion to be exactly semi-circular, but it is important for its radius of curvature to be greater than the radius of the rod on which the device of the invention is to be used. Naturally, the width of the curved element corresponds to the width of the tab to be used, while the straps may be of smaller width. When the tab is in place, the hanging device of the invention is not visible.

In a second variant, the strip has two flexible straps united by a tongue provided with transverse ribs which, when the strip is folded over, impart a curved shape to the tongue. Under such circumstances, prior to being put into place, the device of this variant is flat.

The tab used in co-operation with the device of the invention differs from tabs known in the prior art in that it includes two small pockets at its respective ends, formed by folding over flaps of cloth, with the free ends of the two flexible straps of the device being slid into the pockets, the length of the tab being equal to twice the height of the device of the invention.

The device may be thermoformed or molded as a single piece, advantageously using a plastics material that gives rise to colorless products. A smooth inside surface is necessary to ensure that the device of the invention slides on a rod made of wood, of metal, or of plastics. In the second variant, the smooth inside surface is obtained by sticking on a thin film of plastics material that closes at least those ribs that are located in the upper portion of the curved portion, with the film advantageously having anti-adhesion properties. These properties can be obtained by using a silicone-based substance.

Other characteristics and advantages of the device of the present invention appear on reading the following detailed description given with reference to the accompanying drawings, in which.

Figure 1:
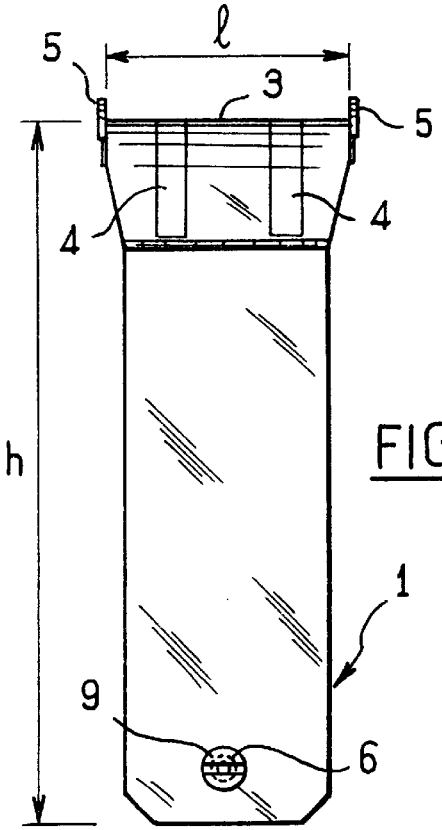
FIG. 1 is a front view of an embodiment of the hanging device of the invention.

The hanging device of the invention is constituted by two flexible straps 1 and 2 connected together by a curved element 3. The curved element 3 is stiffened by being a little thicker than the straps 1 and 2, and above all by the presence of one or more stiffening ribs 4. In the embodiment shown in FIGS. 1 and 2, two ribs are provided close to the two sides of the element 3. The curved element may extend far enough to form a semicircular element, but no further, in order to facilitate sliding of the element on the curtain rod. The radius of curvature of the element 3 is selected to be greater than the section of the rod with which it is to be used. The degree to which the element 3 is stiffened is such that said element does not give rise to any pinching effect under the weight of cloth, in particular when used in the less-preferred fastening with both straps on the same side of the curtain.

Two upwardly-projecting rims 5 are formed on the edges of the curved element 3 in order to hold the tab in place on the device of the invention. Advantageously, the rims 5 extend only over the top portions of the circular arcs defining the curved element, and not over their full extent.

At the free end of each strap 1 and 2, there is a hole 6 in which there is engaged the fastener for fastening to the top of the curtain. The fastener is constituted by two pins 7 and 8, each having a respective head 9. One of the pins, e.g. the pin 7, is tapped and it receives a threaded pin 8 of smaller diameter. The two pins may also be secured to each other by snap-fastening. For fastening to the top of the curtain, the two pins are disengaged, and pass through a hole formed in the top of the curtain, e.g. with the help of an eyelet, and then they are re-engaged one in the other. The curtain is thus held inside the hanging device of the invention and as a result is indeed vertical.

Figure 3:
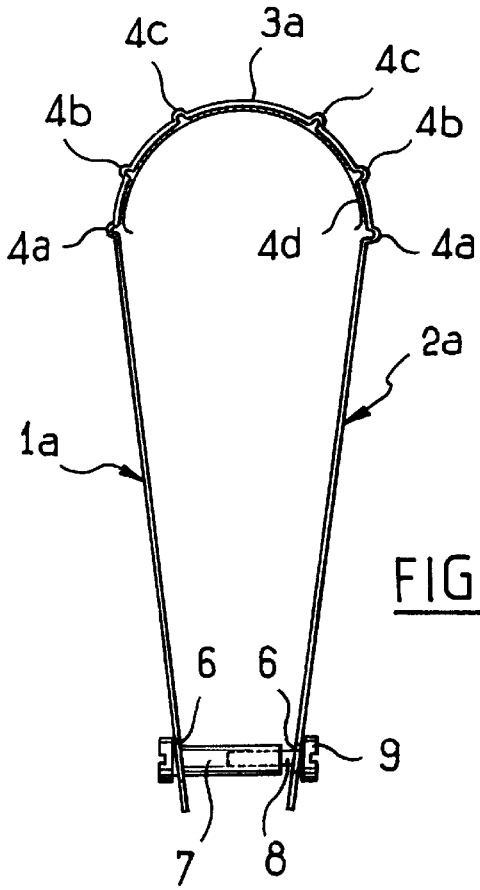
FIG. 3 is a side view of a second embodiment of the device.

Another device of the invention is shown in side view in FIG. 3. It comprises two straps 1*a* and 2*a* interconnected by a tongue 3*a*. The straps 1*a* and 2*a* are similar to the straps 1 and 2 of FIGS. 1 and 2.

Ribs 4*a*, 4*b*, and 4*c* are disposed transversely across the tongue 3*a*. The ribs 4*a* form the junctions between the tongue 3*a* and the straps 1*a* and 2*a*. The ribs 4*b* and 4*c* ensure that the tongue 3*a* curves regularly. The ribs may all be equidistant from one another or they may be distributed in two separate groups about a central portion that is wider than the spaces between ribs. It is this distribution as two groups which is shown by way of illustration in FIG. 3.

The ribs may be formed by extra thickness of the tongue, however they may also be formed by forcing back tongue material along lines corresponding to the locations of the ribs, thereby causing the ribs to be substantially hollow and rounded in shape.

A thin film 4*d* is stuck over the inside surface of the curved portion, serving to close at least the ribs 4*b* and 4*c*. For ease of understanding, the film 4*d* is shown peeled away slightly from the ribs 4*a*. These ribs could likewise be closed if so desired.

The total number of ribs may vary depending on the length of the tongue 3*a* which is itself a function of the diameter of the curtain rod, and once curved the tongue must satisfy the same conditions as the rigid curved element of the first embodiment.

When the fasteners 7, 8, 9 (identical to those of FIGS. 1 and 2) are removed, the assembly comprising the tongue 3*a* and the two straps 1*a* and 2*a* takes up a flat shape like a conventional tab.

As in the case of the rigid curve element 3 of the first embodiment, the outer portion of the tongue 3*a* may have a texture that is non-slip for cloth.

Figure 2:
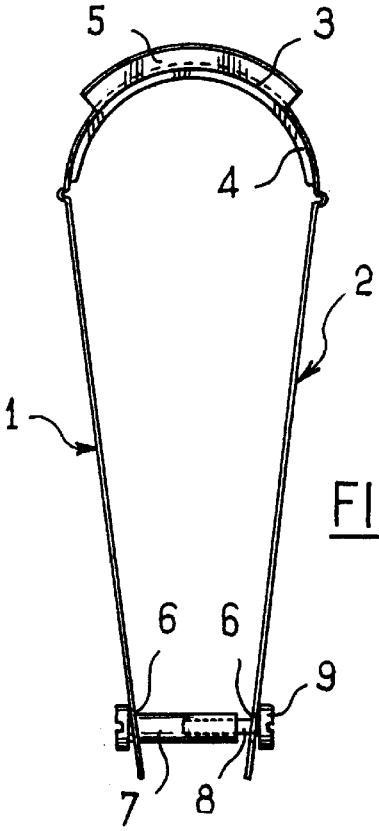
FIG. 2 is a side view of the FIG. 1 device.
Figure 4:
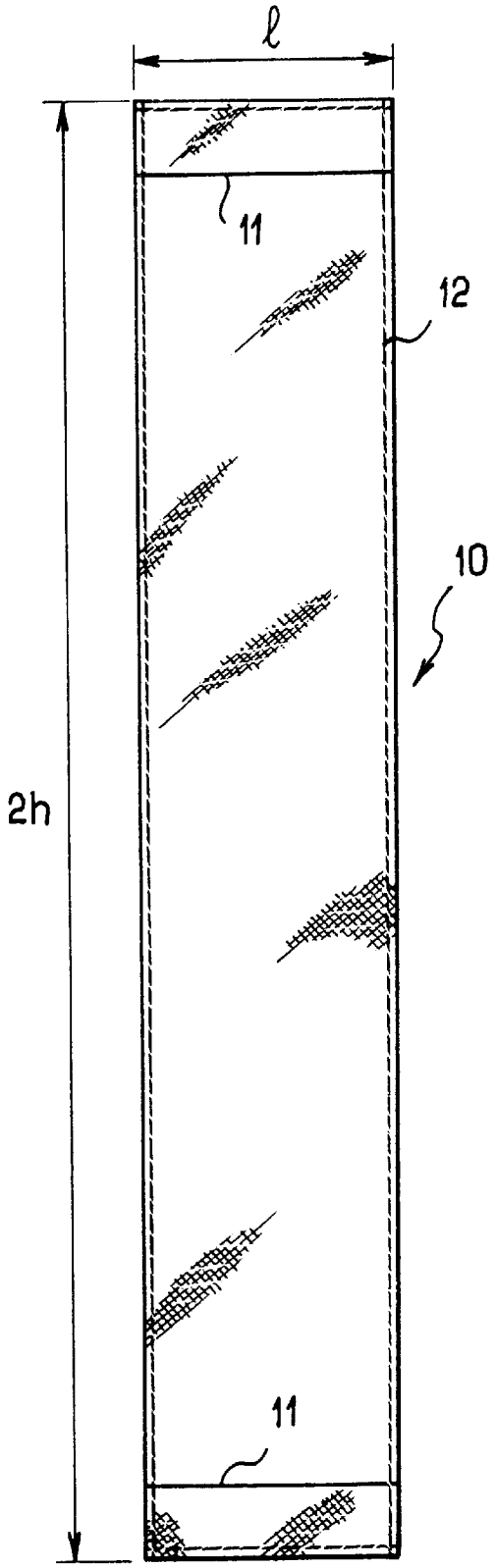
FIG. 4 is a plane view of a tab for use with the device of FIGS. 1 to 3.

FIG. 4 shows a tab 10 for use with the device of FIGS. 1 to 3. It is constituted by a strip of cloth, generally of double thickness, having a length 2h, i.e. corresponding to twice the height h of the device of FIG. 1, and a width l equal to the dimension l of the curved element 3. Respective shallow pockets 11 are formed on one of the faces of the tab 10 at both of its ends and they are held by the stitching 12 of the tab. These pockets are intended to receive the free ends of the straps 1 and 2 beneath the curtain-fixing device. The tab then covers the device of the invention, hiding it completely.

The heads 9 may be provided with slots enabling the pins to be tightened by means of a screwdriver, or with any other means enabling pairs of pins to be engaged and disengaged.

They may also be fitted with orifices for receiving, through the cloth of the tab, an element for securing decoration, e.g. studs having heads of various shapes.

I claim:

1. A curtain hanger device, in the form of an elongate plastic strip, comprising:

a central arcuate portion;

two flexible strap portions, extending from opposite longitudinal ends of said arcuate portion; and means, connected to said arcuate portion, for retaining a decorative tab of a curtain.

2. A device according to claim 1, wherein said tab retaining means comprises a rim projecting above the convex surface on each lateral side of said arcuate portion.

3. A device according to claim 1, wherein said arcuate portion comprises one or more ribs along its curvature.

4. A curtain hanger device, in the form of an elongate plastic strip, comprising:

a central arcuate portion, having one or more transverse ribs running perpendicular to its curvature; and two flexible strap portions, extending from opposite longitudinal ends of said arcuate portion.

5. A curtain hanger device, in the form of an elongate plastic strip, comprising:

a central arcuate portion;

two flexible strap portions, extending form opposite longitudinal ends of said arcuate portion;

a fastener, connected adjacent the free ends of said flexible strap portions, for fastening the device to a curtain, and wherein said fastener comprises a shaft, having retaining heads on opposite ends thereof, passing through corresponding holes adjacent the free ends of said flexible strap portions.

6. A device according to claim 5, wherein said shaft comprises a male pushbutton element engaged within a female pushbutton element.

7. A device according to claim 5, wherein said shaft comprises a male screw-engaged element engaged within a female screw-engaged element.

8. A curtain hanger device, in the form of an elongate plastic strip, comprising:

a central arcuate portion, having on its convex surface a surface texture that is non-slip as to cloth; and two flexible strap portions, extending from opposite longitudinal ends of said arcuate portion.

9. A curtain tab for use with a curtain hanging device, that is in the form of an elongate plastic strip comprising a central arcuate portion and two flexible strap portions extending from opposite longitudinal ends of said arcuate portion, said tab comprising:

an elongate strip of cloth; and a pocket at each end thereof for receiving the free ends of the flexible strap portions of said curtain hanging device.

10. A combination of a curtain hanger device and a curtain tab, wherein:

said curtain hanger device, in the form of an elongate plastic strip, comprises a central arcuate portion and two flexible strap portions extending from opposite longitudinal ends of said arcuate portion;

said curtain tab comprises an elongate strip of cloth and a pocket at each end thereof for receiving a corresponding free end of each of said flexible strap portions.

* * * * *